US005655772A

United States Patent [19]

Muelver

[11] Patent Number: 5,655,772

[45] Date of Patent: Aug. 12, 1997

[54] BINGO DEVICE

[76] Inventor: Vance J. Muelver, W270 N. 3894 Parkside Rd., Pewaukee, Wis. 53072

[21] Appl. No.: 761,946

[22] Filed: Dec. 9, 1996

[51] Int. Cl.[6] ..... A63F 9/00

[52] U.S. Cl. ..... 273/148 A; 273/148 R; 40/658; 206/579

[58] Field of Search ..... 273/148 R, 148 A, 273/309; 206/477, 315.1, 579; 40/658, 601, 584

[56] References Cited

U.S. PATENT DOCUMENTS

| | | | |
|---|---|---|---|
| 909,219 | 1/1909 | Putnam | 40/658 |
| 1,415,540 | 5/1922 | Fesser | 40/658 X |
| 4,009,532 | 3/1977 | Thomas | 40/658 |
| 4,337,861 | 7/1982 | Smart | 206/579 |
| 4,572,510 | 2/1986 | Green | 273/148 R |
| 4,761,008 | 8/1988 | Huggins | 273/148 R |
| 5,358,246 | 10/1994 | Dziedzic | 273/148 A |
| 5,495,947 | 3/1996 | Zarske | 206/579 |

*Primary Examiner*—Raleigh W. Chiu

[57] ABSTRACT

A help-in-hand device that includes a housing member. The housing member has a base portion with four peripheral walls attached. The base has an upper surface that is accessible from within the housing member. Included are a pair of linear raised portions that are attached to the upper surface of the base portion. The pair of linear raised portion are spaced apart so as to define a channel. An extension pole with a bulbous end is coupled within the channel to the pair of linear raised portions. The extension pole is capable of rotating upward and downward within the housing. A clip is attached to the extension pole and capable of clasping a bingo card. Lastly, a lid is provided. The lid has a top portion with a front end, a back end and a pair of side ends. The lid is capable of being slidably positioned over the housing.

11 Claims, 3 Drawing Sheets

BINGO DEVICE

BACKGROUND OF THE INVENTION

1. Field of the Invention

The present invention relates to a help-in-hand device and more particularly pertains to providing an accessory device for bingo players that can store bingo supplies and provide means to raise a winning bingo card.

2. Description of the Prior Art

The use of a card display stand is known in the prior art. More specifically, card display stands heretofore devised and utilized for the purpose of holding cards up are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,358,246 to Dziedzie discloses a card holder and signal device. U.S. Pat. No. 4,572,510 to Green discloses a bingo indicator. U.S. Pat. Des. No. 249,782 to Marcus discloses a portable signal flag. U.S. Pat. No. 5,103,582 to Farmer discloses a display sign. U.S. Pat. No. 4,291,882 to DelMonte discloses a bingo card holder. Lastly, U.S. Pat. No. 4,009,432 to Thomas discloses an adjustable display stand.

While these devices fulfill their respective, particular objectives and requirements, the aforementioned patents do not describe help-in-hand device that allows the bingo player to have an accessory that will raise their winning bingo card and provide storage for other bingo supplies.

In this respect, the help-in-hand device according to the present invention substantially departs from the conventional concepts and designs of the prior art, and in doing so provides an apparatus primarily developed for the purpose of providing an accessory device for bingo players that can store bingo supplies and provide means to raise a winning bingo card.

Therefore, it can be appreciated that there exists a continuing need for a new and improved help-in-hand device which can be used for providing an accessory device for bingo players that can store bingo supplies and provide means to raise a winning bingo card. In this regard, the present invention substantially fulfills this need.

SUMMARY OF THE INVENTION

In view of the foregoing disadvantages inherent in the known types of card display stands now present in the prior art, the present invention provides an improved help-in-hand device. As such, the general purpose of the present invention, which will be described subsequently in greater detail, is to provide a new and improved help-in-hand device and method which has all the advantages of the prior art and none of the disadvantages.

To attain this, the present invention essentially comprises a housing member that has a base portion with four peripheral walls attached. Each of the four walls have a rim portion along a top edge. The four walls form a front wall, a back wall and a pair of side walls. The base has an upper surface that is accessible from within the housing member. A pair of linear raised portions are attached to the upper surface of the base portion of the housing. Each linear raised portion is generally rectangular and parallel one to another. Each linear portion is attached at one end to the front wall and spaced from the back wall at another end. Each linear raised portion is spaced from one of the side walls of the housing. The pair of linear raised portions are spaced apart for defining a channel. Included is an extension pole that has a bottom tubular member. The bottom tubular member has a top rod and an intermediate tubular members nested therein. The bottom tubular member has a bulbous end and an upper edge. The bulbous end is pivotally mounted between the pair of linear raised portion within the housing. The bottom tubular member, with the top rod and intermediate tubular member nested therein, is capable of rotating upward and downward within the housing at the bulbous end. The bottom tubular member is vertical the base when rotated upward within the housing. The bottom tubular member is capable of allowing the extending of the top rod and the intermediate tubular member. The top rod and the bottom tubular member are locked in the extended orientation. The top rod, when removed from within the bottom tubular member, is extended beyond the upper edge thereof for increasing a length of the extension pole. A clipping means for clasping a bingo card is attached to the top rod. The clipping means is capable of allowing the top rod to be pulled from within the bottom tubular member when the bottom tubular member is vertical the housing. Lastly, a lid is provided. The lid has top portion with a front end, a back end and a pair of side ends. The front end and back end are flush the top portion. The pair of side ends each having an over hang. The over hang of each side end has an inward facing flange. The lid is capable of being slidably positioned over the housing with the flange of each side engaging the rim of the housing.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved help-in-hand device which has all of the advantages of the prior art card display stands and none of the disadvantages.

It is another object of the present invention to provide a new and improved help-in-hand device which may be easily and efficiently manufactured and marketed.

It is further object of the present invention to provide a new and improved help-in-hand device which is of durable and reliable constructions.

An even further object of the present invention is to provide a new and improved help-in-hand device which is susceptible of a low cost of manufacture with regard to both materials and labor, and which accordingly is then susceptible of low prices of sale to the consuming public, thereby making such help-in-hand device economically available to the buying public.

Even still another object of the present invention is to provide a help-in-hand device for providing an accessory device for bingo players that can store bingo supplies and provide means to raise a winning bingo card.

Lastly, it is an object of the present invention to provide a new and improved help-in-hand device including a housing member. The housing member has a base portion with four peripheral walls attached. The base has an upper surface that is accessible from within the housing member. Included are a pair of linear raised portions that are attached to the upper surface of the base portion. The pair of linear raised portion are spaced apart so as to define a channel. An extension pole with a bulbous end is coupled within the channel to the pair of linear raised portions. The extension pole is capable of rotating upward and downward within the housing. A clipping means is attached to the extension pole and capable of clasping a bingo card. Lastly, a lid is provided. The lid has a top portion with a front end, a back end and a pair of side ends. The lid is capable of being slidably positioned over the housing.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figures 1, 2:
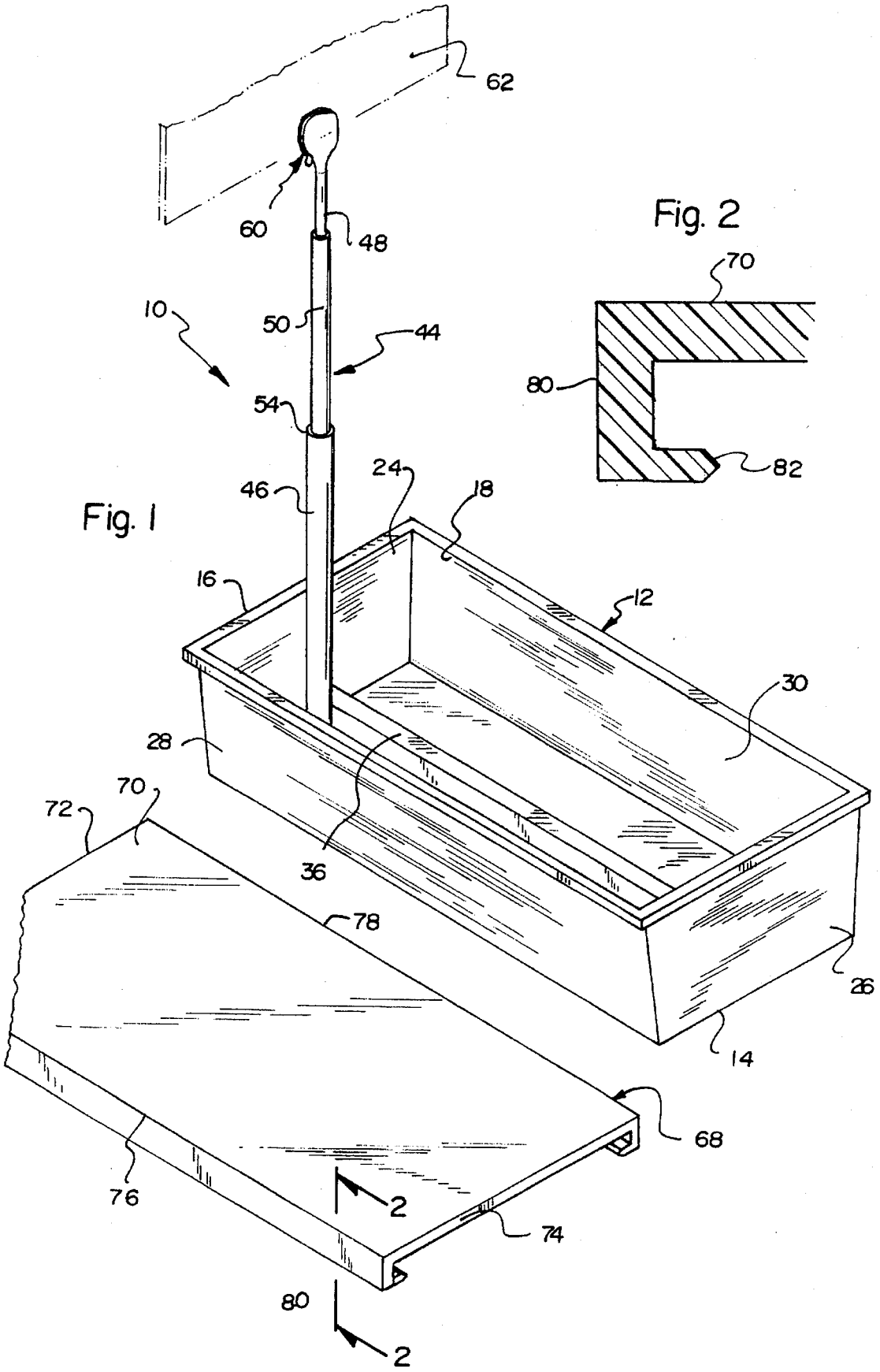
FIG. 1 is a perspective view of the preferred embodiment of the help-in-hand device constructed in accordance with the principles of the present invention.
FIG. 2 is a cross-sectional view of the lid of the present invention taken along line 2—2 of FIG. 1.

With reference now to the drawings, and in particular to FIG. 1 thereof, the preferred embodiment of the new and improved help-in-hand device embodying the principles and concepts of the present invention and generally designated by the reference numeral 10 will be described.

The present invention, the help-in-hand device 10 is comprised of a plurality of components. Such components in their broadest context include a housing, a lid and a tubular member. Such components are individually configured and correlated with respect to each other so as to attain the desired objective.

Figure 3:
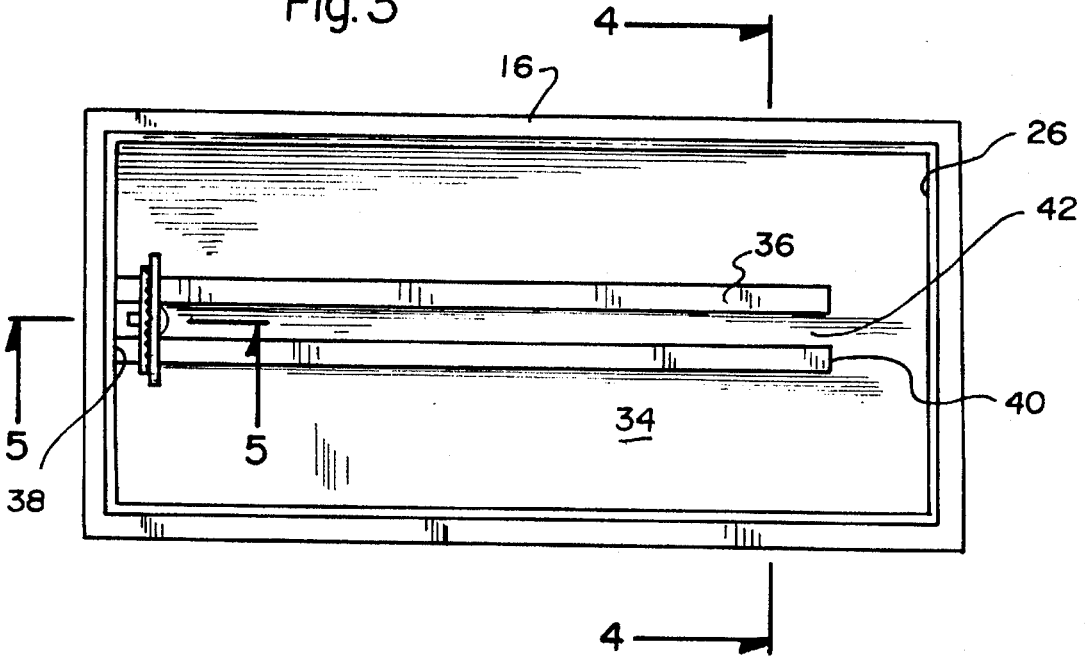
FIG. 3 is a top plan view of the present invention in an operable orientation.
Figure 4:
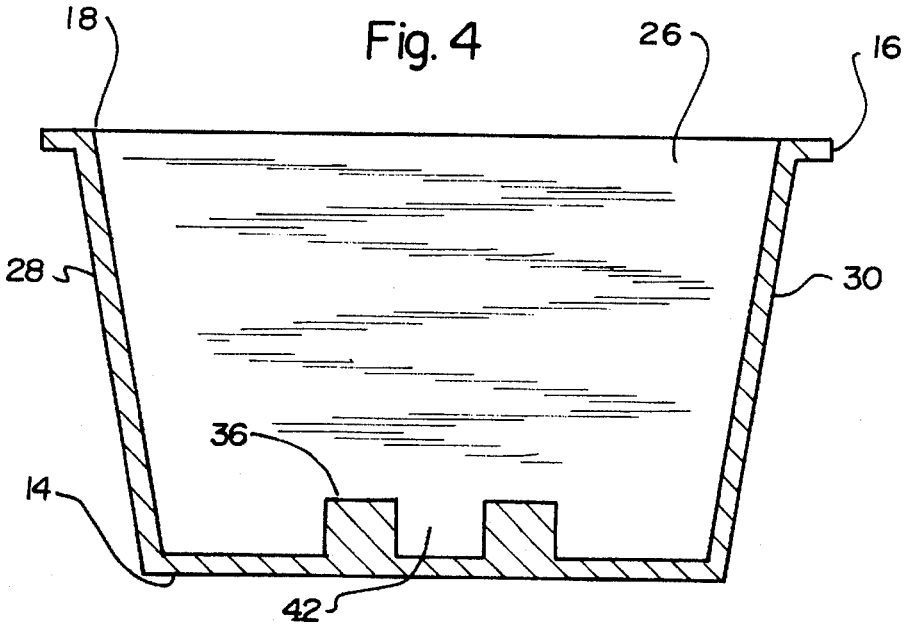
FIG. 4 is a cross-sectional view of the present invention taken along line 4—4 of FIG. 3.

Specifically, the present invention includes a housing member 12. The shape and size of the housing member may vary. The housing may have a length of between about 6 to 8 inches and a width of about between 3¼ to 5¼ inches. The housing has a base portion 14 with four peripheral walls attached. Each of the four walls have a rim portion 16 along a top edge 18, as shown in FIG. 4. The four walls forming a front wall 24, a back wall 26 and a pair of side walls 28 and 30. FIG. 3 shows the base 14 with an upper surface 34 that is accessible from within the housing member.

Also, a pair of linear raised portions 36 are attached to the upper surface 34 of the base portion of the housing 12. Each linear raised portion, as depicted in FIG. 4, is generally rectangular and parallel one to another. Each linear raised portion is attached at one end 38 to the front wall and spaced from the back wall 26 at another end 40. Each linear raised portion is spaced from one of the side walls 28 and 30 of the housing. The pair of linear raised portions are spaced apart for defining a channel 42.

Figure 5:
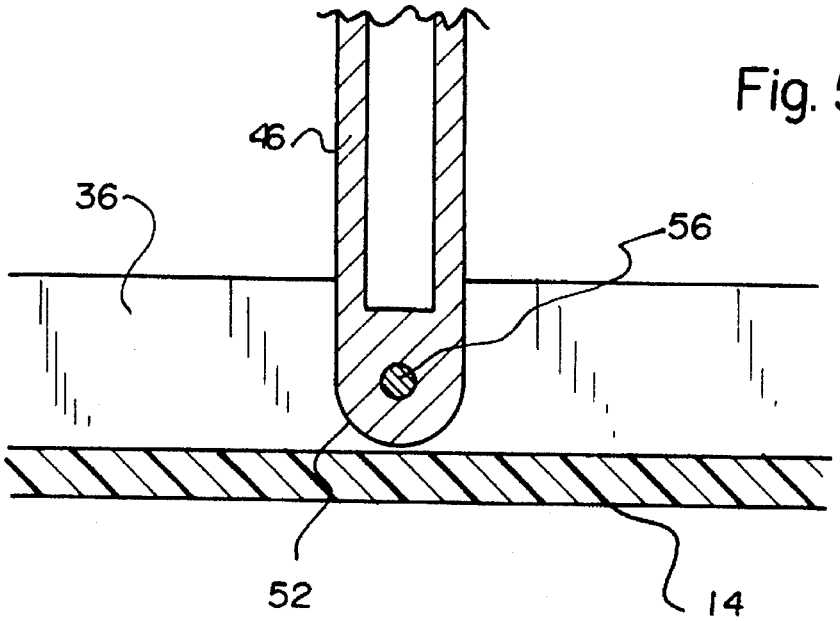
FIG. 5 is a cross-sectional view of the present invention taken along line 5—5 of FIG. 3.

Additionally, an extension pole is provided 44. The extension pole, as seen in FIG. 1, has a bottom tubular member 46 with a top rod member 48 and an intermediate tubular members 50 nested within. The bottom tubular member 46 has a bulbous end 52 and an upper edge 54. FIG. 5 shows the bulbous end pivotally mounted between the pair of linear raised portions 36 within the housing by a pivot pin 56. The bottom tubular member, with the top rod and intermediate tubular member nested within, will rotate upward and downward within the housing at the bulbous end. When the extension pole is rotated downward it can be positioned within the channel of the housing for storage.

The bottom tubular member 46 is vertical the base 14 when rotated upward within the housing. When the bottom tubular member is rotated upward it allows the top rod 48 and the intermediate tubular member 50 to be extended in a telescoping manner. The top rod and the bottom tubular member are locked in the extended orientation so that the extension pole remains positioned above the housing 12. The top rod, when removed from within the bottom tubular member, is extended beyond the upper edge thereof to increase a length of the extension pole 44.

Figure 6:
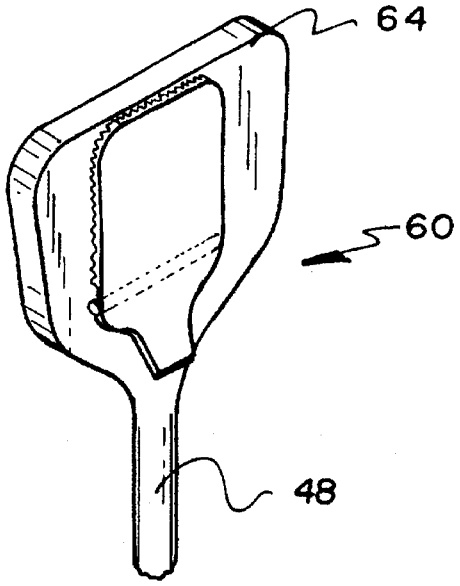
FIG. 6 is an isometric view of the clamp means of the present invention as seen in FIG. 1.

As best illustrated in FIG. 6, a clipping means 60 is provided. The clipping means is preferably an alligator type clip that can clamp onto or clasping a bingo card 62 or any similar card. The clipping means has a frame member 64 interconnected to the top rod 48. The clipping means may be a ring with type clip with a groove for receiving the card within. The clipping means is capable of allowing the top rod 48 to be pulled from within the bottom tubular member when the bottom tubular member is vertical the housing. When extension pole positioned within the channel of the housing the clipping means is extended beyond the channel.

Lastly, a lid 68 is included. The lid has top portion 70 with a front end 72, a back end 74 and a pair of side ends 76 and 78. The front end and back end are flush the top portion, as shown in FIG. 1. The pair of side ends each has an over hang 80. FIG. 2 shows the over hang of each side end as having an inward facing flange 82 with a tapered end. The lid is capable of being slidably positioned over the housing. When the lid is slid onto the housing, the flange of each side engages the rim 16 of the housing. The lid will enclose the extension pole within the housing when it is in the down position. The housing is capable of receiving other bingo accessories for storage when the lid is in position.

The present invention help-in-hand device is an accessory for bingo. The housing member with the lid is a carrying and storage container for bingo supplies. Extension pole allows the bingo player to raise their bingo card or food order slip. The use of the extension pole is to aid the bingo player that has difficulty raising their arm. The present invention is formed of a rigid plastic. The top rod of the extension pole may be threaded so as to accommodate a variety of clipping means. Finally, the help-in-hand of the present invention is lightweight, compact and easily carried.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved help-in-hand device for storage of bingo game pieces and displaying a bingo card comprising in combination:

a housing member having a base portion with four peripheral walls attached thereto, each of the four walls having a rim portion along a top edge thereof, the four walls forming a front wall, a back wall and a pair of side walls, the base having an upper surface being accessible from within the housing member;

a pair of linear raised portions being attached to the upper surface of the base portion of the housing, each linear raised portion being generally rectangular and parallel one to another, each linear portion being attached at one end to the front wall and spaced from the back wall at another end, each linear raised portion being spaced from one of the side walls of the housing, the pair of linear raised portions being spaced apart for defining a channel therebetween;

an extension pole having a bottom tubular member with a top rod and an intermediate tubular members being nested therein, the bottom tubular member having a bulbous end and an upper edge, the bulbous end being pivotally mounted between the pair of linear raised portion within the housing, the bottom tubular member having the top rod and intermediate tubular member nested therein being capable of rotating upward and downward within the housing at the bulbous end, the bottom tubular being vertical the base when rotated upward within the housing and capable of allowing the extending of the top rod and the intermediate tubular member, the top rod and the bottom tubular member being locked in the extended orientation, the top rod when removed from within the bottom tubular member being extended beyond the upper edge thereof for increasing a length of the extension pole;

a clipping means for clasping a bingo card being attached to the top rod, the clipping means capable of allowing the top rod to be pulled from within the bottom tubular member when the bottom tubular member is vertical the housing; and a lid having top portion with a front end, a back end and a pair of side ends, the front end and back end being flush the top portion, the pair of side ends each having an over hang, the over hang of each side end has an inward facing flange, the lid being capable of being slidably positioned over the housing with the flange of each side engaging the rim of the housing.

2. The help-in-hand device comprising:

a housing member having a base portion with four peripheral walls attached thereto, the base having an upper surface being accessible from within the housing member;

a pair of linear raised portions being attached to the upper surface of the base portion and being spaced apart so as to define a channel therebetween;

an extension pole having a bulbous end being coupled within the channel to the pair of linear raised portions and capable of rotating upward and downward within the housing;

a clipping means being attached to the extension pole and capable of clasping a bingo card; and a lid having top portion with a front end, a back end and a pair of side ends, the lid capable of being slidably positioned over the housing.

3. The help-in-hand device as set forth in claim 2, wherein the four walls of the housing form a front wall, a back wall and a pair of side walls with each of the four walls having a rim portion along a top edge thereof.

4. The help-in-hand device as set forth in claim 3, wherein each linear raised portion of the housing being attached at one end to the front wall and spaced from the back wall at another end, each linear raised portion generally rectangular and parallel one to another, and each linear raised portion being spaced from one of the side walls of the housing.

5. The help-in-hand device as set forth in claim 3, wherein the front end and back end of the lid being flush the top portion, and the pair of side ends of the lid each having an over hang.

6. The help-in-hand device as set forth in claim 5, wherein the over hang of each side end of the lid has an inward facing flange, with the flange of each side engaging the rim of the housing.

7. The help-in-hand device as set forth in claim 2, wherein the extension pole having a bottom tubular member with a top rod and an intermediate tubular members being nested therein and an upper edge.

8. The help-in-hand device as set forth in claim 7, wherein the bulbous end being on the bottom tubular member of the extension pole and being pivotally mounted between the pair of linear raised portion within the housing.

9. The help-in-hand device as set forth in claim 8, wherein the bottom tubular member, with the top rod and intermediate tubular member nested therein, being capable of rotating vertical the housing and parallel the base of the housing, and the bottom tubular being vertical the base when rotated upward within the housing and capable of allowing the top rod and the intermediate tubular member to be extended.

10. The help-in-hand device as set forth in claim 9, wherein the top rod and the bottom tubular member being locked in the extended orientation, the top rod when removed from within the bottom tubular member being extended beyond the upper edge thereof for increasing a length of the extension pole.

11. The help-in-hand device as set forth in claim 2, wherein the clipping means being an alligator clip and capable of allowing the top rod to be pulled from within the bottom tubular member when the bottom tubular member is vertical the housing.

* * * * *